US006655553B2

(12) United States Patent
Staniszewski et al.

(10) Patent No.: US 6,655,553 B2
(45) Date of Patent: Dec. 2, 2003

(54) DISPENSING CLOSURE WITH TAMPER-EVIDENT SLEEVE

(75) Inventors: Joseph W. Staniszewski, Rockford, IL (US); David S. Pozgay, Chicago, IL (US); Cori M. Blomdahl, Muskego, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/179,803

(22) Filed: Jun. 25, 2002

(65) Prior Publication Data

US 2002/0166873 A1 Nov. 14, 2002

Related U.S. Application Data

(63) Continuation-in-part of application No. 10/086,234, filed on Feb. 27, 2002, which is a continuation of application No. 09/696,681, filed on Oct. 25, 2000, now abandoned.

(51) Int. Cl.[7] ..... B67B 5/00

(52) U.S. Cl. ..... 222/153.07; 222/153.06; 222/562; 215/251; 215/253

(58) Field of Search ..... 222/153.07, 153.06, 222/556, 563; 215/235, 237, 253, 251, 254, 274; 220/319, 270, 847, 837

(56) References Cited

U.S. PATENT DOCUMENTS

| | | | | |
|---|---|---|---|---|
| 1,214,675 A | * | 2/1917 | Heath | 215/253 |
| 1,965,713 A | | 7/1934 | Shaw | |
| 2,108,583 A | * | 2/1938 | Falk | 215/274 |
| 2,705,085 A | | 3/1955 | Glensky | |
| 2,787,394 A | | 4/1957 | Beaumann | |
| 3,208,649 A | | 9/1965 | Fields | |
| 3,596,790 A | | 8/1971 | Lefault, Jr. | |
| 3,603,472 A | | 9/1971 | Lecinski, Jr. et al. | |
| 3,690,499 A | | 9/1972 | Westfall et al. | |
| 3,785,519 A | | 1/1974 | Hugh | |
| 3,799,381 A | | 3/1974 | Acton | |
| 3,823,841 A | | 7/1974 | Lovejoy | |
| 3,901,403 A | | 8/1975 | Menke | |
| 3,923,183 A | | 12/1975 | Choksi | |
| 3,945,525 A | | 3/1976 | Jones | |
| 3,946,889 A | | 3/1976 | Gach | |

(List continued on next page.)

FOREIGN PATENT DOCUMENTS

WO WO 99/58418 11/1999

OTHER PUBLICATIONS

U.S. patent application Ser. No. 09/946,681, filed Oct. 25, 2000 and Information Disclosure Statement, First Supplemental Information Disclosure Statement, Second Supplemental Information Disclosure Statement, and Form PTO 892.

U.S. patent application entitled "dispensing closure With Tamper–Evident Sleeve," filed Feb. 27, 2002 by inventors Joseph W. Staniszewski, David D. Pozgay, and Cori M. Blomdahl, and the Information Disclosure Statement.

*Primary Examiner*—Gene Mancene
*Assistant Examiner*—Frederick C Nicolas
(74) *Attorney, Agent, or Firm*—Wood, Phillips, Katz, Clark & Mortimer

(57) ABSTRACT

A closure structure for a container includes a cap and a surrounding tamper-evident sleeve. The tamper-evident sleeve is initially engageable with a retaining element of the container located below the cap to prevent axial upward displacement of the sleeve with respect to the container. The sleeve includes a retention member overlying the cap to prevent manipulation of the cap to an open condition. The sleeve includes a frangible feature arranged to be torn to facilitate removal of the sleeve to permit manipulation of the cap to an open condition.

21 Claims, 9 Drawing Sheets

U.S. PATENT DOCUMENTS 3,952,901 A 4/1976 Conti
3,971,488 A 7/1976 McRoskey et al.
4,073,399 A 2/1978 Lewis
4,176,755 A 12/1979 Winchell
4,279,353 A 7/1981 Honma
4,371,089 A 2/1983 Barendregt
4,433,790 A 2/1984 Gibson
4,467,931 A 8/1984 Gach
4,487,324 A 12/1984 Ostrowski
4,595,123 A 6/1986 Libit
4,709,823 A 12/1987 Beck
4,733,787 A 3/1988 Knopf et al.
4,746,035 A 5/1988 Anderson et al.
4,752,013 A 6/1988 Miller et al.
4,779,750 A 10/1988 Armstrong
4,801,054 A 1/1989 Nycz
4,821,897 A 4/1989 Weiler
4,830,208 A 5/1989 Osting et al.
4,874,101 A 10/1989 Zalut
4,984,716 A 1/1991 Beck
5,065,883 A 11/1991 Udell
5,080,245 A 1/1992 Conard
5,085,333 A 2/1992 Dutt et al.
5,100,011 A 3/1992 Maietta
5,107,998 A 4/1992 Zumbuhl
5,129,531 A * 7/1992 Beck et al. ..... 215/256
5,284,264 A 2/1994 Gross
5,320,235 A 6/1994 Joyce
5,456,374 A 10/1995 Beck
5,462,181 A 10/1995 Glynn
5,467,879 A 11/1995 Moore
D366,418 S 1/1996 Lown et al.
5,497,906 A 3/1996 Dubach
5,524,782 A 6/1996 Salemi
5,544,770 A 8/1996 Travisano
5,611,445 A 3/1997 Kano et al.
5,662,247 A 9/1997 Rapchack et al.
5,667,086 A * 9/1997 Guerre ..... 215/251
5,735,419 A 4/1998 Ma
5,833,123 A 11/1998 Gueret
5,875,906 A 3/1999 Price et al.
5,875,942 A 3/1999 Ohmi et al.
5,884,788 A 3/1999 Wilde
5,918,752 A 7/1999 Meyer
5,975,369 A 11/1999 Yurkewicz et al.
5,992,659 A 11/1999 Nofer et al.
5,996,849 A 12/1999 Bansal
6,039,218 A 3/2000 Beck
6,050,434 A 4/2000 McNab
6,050,436 A 4/2000 Bennett et al.
6,095,354 A 8/2000 Herr et al.
6,116,445 A 9/2000 Ikemori
6,116,477 A 9/2000 Kreiseder et al.
6,269,986 B1 8/2001 Gross

* cited by examiner

DISPENSING CLOSURE WITH TAMPER-EVIDENT SLEEVE

CROSS REFERENCE TO RELATED APPLICATION

This application is a continuation-in-part of U.S. application Ser. No. 10/086,234, entitled "Dispensing Closure With Tamper-Evident Sleeve," filed by inventors Joseph W. Staniszewski, David D. Pozgay, and Cori M. Blomdahl on Feb. 27, 2002, which is a continuation application of U.S. patent application Ser. No. 09/696,681, filed Oct. 25, 2000 abandoned .

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The invention relates to closures for containers. More particularly, the invention relates to closures having tamper indicating features which must be broken or torn to initially open the closure.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence—even after the lid or spout has been subsequently closed. U.S. Pat. Nos. 4,487,324; 4,941,592; 5,201,440 and 5,875,907 disclose closures which incorporate a locking band or tab that is attached to either the lid or the body of the closure with a plurality of frangible webs so as to initially retain the closure lid to the body in the closed position. To initially open the closure, the user must break the frangible webs by pushing or pulling on a tab or band.

While the above-mentioned closures can function well for the purposes for which they have been designed, it would be desirable to provide an improved tamper-evident closure which could be readily fabricated to associate with certain types of lids or flow control elements and which, prior to initial opening, could enhance the cosmetic appearance of the closure. It would be desirable if such a tamper-evident closure could be easily installed on a container in its tamper-indicating ready condition for eventual delivery to the consumer.

It would also be desirable to provide an improved tamper-evident closure comprising at least two separate components wherein the components could be advantageously designed to be frictionally held together prior to assembly of the closure on the container. In particular, it would be beneficial if the improved closure could accommodate a design providing sufficient frictional engagement between two components of the closure to allow the components to be assembled together and maintained in that assembled configuration during subsequent handling, shipping, and installation of the assembled two-closure components together on a container by automatic capping equipment. However, it would also be beneficial if the improved closure could accommodate an alternate design wherein such frictional engagement would not necessarily be required when the installation of the components is to be made directly onto a container without necessarily requiring assembly of the closure components prior to installation on the container.

It would also be beneficial if such an improved closure could readily accommodate its manufacture from a variety of different materials. Further, it would be desirable if such an improved closure could be provided with a design that would accommodate efficient, high quality, large volume manufacturing techniques with a minimal product reject rate. Preferably, the improved closure should also accommodate high speed manufacturing techniques that produce products having consistent operating characteristics unit-to-unit with reliability.

The present invention provides an improved closure with tamper-evident features which can accommodate other designs having the above-discussed benefits and features.

BRIEF SUMMARY OF THE INVENTION

The closure structure of the invention provides an effective tamper-indicating feature which evidences unauthorized access or tampering with a contained product.

One form of the invention comprises a closure structure for a container which has a neck defining a dispensing opening and a radially extending retaining element spaced from the dispensing opening. The closure includes a cap having an end wall for at least partially closing the opening of the container neck and having a peripheral skirt for engaging the container neck to mount the cap on the container. A sleeve is provided for surrounding the cap on the container neck. The sleeve has an annular wall sized to surround and engage the cap skirt with sufficient force to hold the sleeve and cap together as a unit and to accommodate installation of the sleeve and cap as a unit on the container neck so that relative rotation between the cap and sleeve is minimized at least during installation of the cap and sleeve together on the container neck. The sleeve has a top retention member extending inwardly from the annular wall over at least part of the cap. The sleeve has a snap-on engagement member engageable with the container retaining element to prevent axial separation of the sleeve from the container neck and to accommodate rotation of the sleeve and cap together in the screwing on direction without fracturing the sleeve. The sleeve also has a frangible feature configured to be torn by a user for permitting at least partial disengagement of the engagement member from the retaining element and subsequent removal of the surrounding sleeve from the container neck. This provides access to the cap.

Another aspect of the invention provides a cap that comprises a closure body and a closure lid accommodating movement relative to the body. The closure body has an annular sidewall for extending from the container neck and has an end wall defining a dispensing orifice in fluid communication with the container dispensing opening. The closure lid has an occluding portion that is movable with the lid to occlude the dispensing orifice in a closed position and that is movable away from the closed position to uncover the dispensing orifice. A tamper-evident sleeve surrounds the closure body and the lid. The sleeve is engageable with the container neck below the closure body to prevent axial upward displacement of the sleeve with respect to the container neck. The sleeve includes a retention member overlying the closure lid to prevent movement of the lid to open the dispensing orifice. The sleeve has a frangible feature that can be torn to permit removal of the retention member from over the lid to allow the lid to be moved to open the dispensing orifice.

Another aspect of the invention provides a tamper-evident sleeve that can be separately molded and assembled over a cap prior to mounting the assembly on a container. The sleeve has an engagement member in the form of a bead which is snapped over a retaining element of the container neck. To facilitate installation of the sleeve and cap together on the container, the sleeve is provided with interior knurling or ribs which engage exterior knurling or ribs on the cap. The mutual engagement of the interior and exterior knurling or ribs ensures mutual turning of the sleeve and cap. This operation is advantageously performed in rapid fashion by a capping machine.

Another form of the invention provides a closure structure for a container which defines a dispensing opening. The structure includes a cap for closing the opening of the container. The structure also includes a separate sleeve which is molded as a unitary structure from a polymer material. The sleeve has an annular wall that (i) is sized to surround the cap on the container, (ii) has an upper opening, and (iii) engages the container to prohibit axial separation of the surrounding sleeve from the container. The sleeve also has a retention member extending across the sleeve upper opening as a unitary part of the sleeve to connect two portions of the annular wall at a location over the upper opening. The sleeve also includes a top frangible line across the retention member at a location over the upper opening. The sleeve further includes a side frangible line extending throughout the height of the annular wall. The sleeve also has a pull tab defined as a unitary part of the retention member between the top frangible line and the sleeve annular wall. The pull tab can be pulled to tear the top frangible line and side frangible line for facilitating removal of the sleeve from the cap and container.

The tamper-evident sleeve of the invention prevents unauthorized and undetected removal or opening of a closure cap from a container, or of a lid and/or a closure body from a container. According to the exemplary embodiment of a closure having a body and lid, the sleeve prevents undetected opening of the closure lid from the closure body, and prevents undetected removal of the closure body from the container neck.

Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

DETAILED DESCRIPTION

Figure 1:
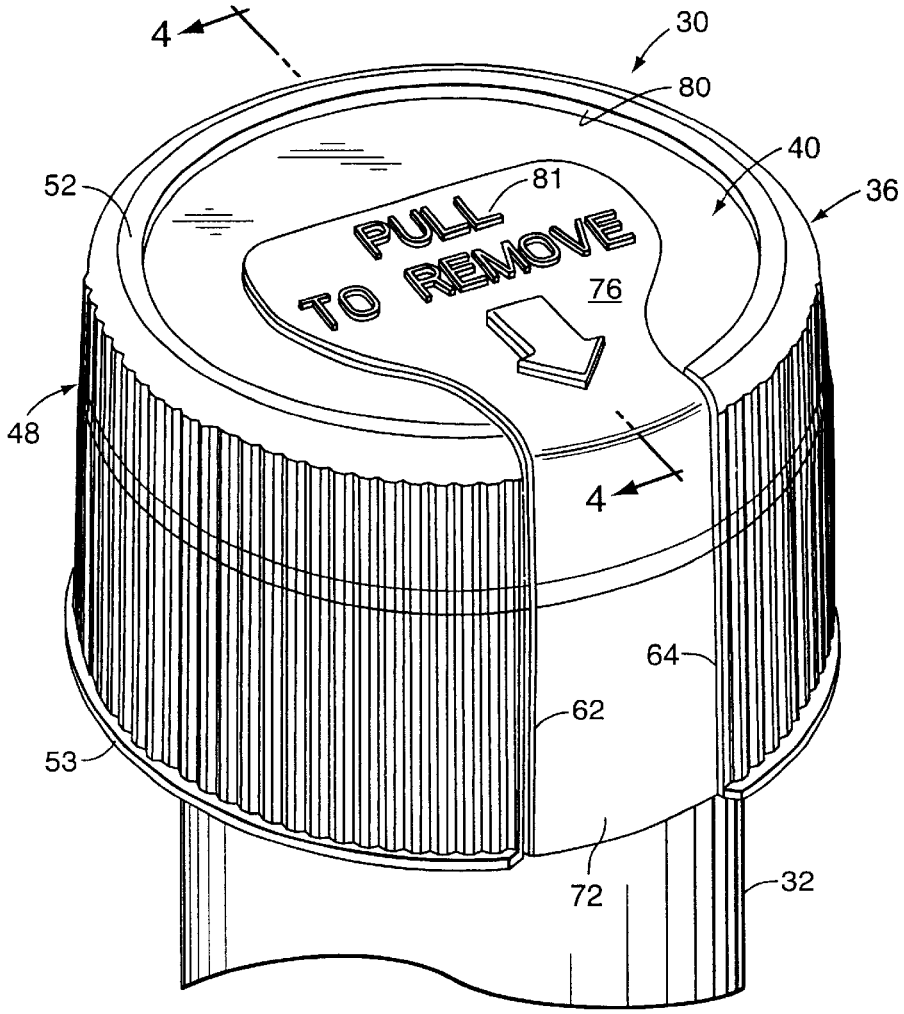
FIG. 1 is a perspective view of a closure structure of the present invention, including a closure assembly surrounded by a tamper-evident sleeve, mounted or installed on a container.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se described herein forms no part of some aspects of the invention and therefore is not intended to limit the present invention. It will also be understood by those of ordinary skill that novel and non-obvious inventive aspects are embodied in the described exemplary closure systems alone.

An exemplary embodiment of a closure structure 30 according to the invention is illustrated in FIGS. 1–4. The closure structure 30 is adapted to engage a container neck 32. The closure structure 30 includes an outer, surrounding tamper-evident sleeve 36 and an inner cap 40. The sleeve 36 is configured to prevent access to the contents of the container until the sleeve is disengaged from the container neck, preferably by removal of the sleeve from the container neck.

The tamper-evident sleeve 36 surrounds the cap 40 and the container neck 32. The sleeve 36 includes an annular sidewall 48, a top retention member in the form of a partially annular lip 52 extending radially inwardly from the sidewall 48, and a bottom engagement member in the form of an internal annular, or partially annular, bead 58 (shown in FIG. 4), extending radially inwardly from the sidewall 48. An external, partially annular flange 53 extends outwardly from a bottom of the annular sidewall 48. The partially annular flange 53 increases the hoop rigidity of the annular sidewall 48 to prevent prying off of the sleeve after its initial installation on the cap 40.

The annular sidewall 48 includes a frangible feature in the form of a first line of weakness 62, and a second frangible feature in the form of a second line of weakness 64. The first and second lines of weakness define a tear strip 72 therebetween. A pull tab 76 extends perpendicularly (radially) from tear strip 72 into a central region 80 of the sleeve. The pull tab 76 can carry molded or other indicia 81 giving opening instructions or other information.

The frangible lines 62, 64 can be made frangible in a number of ways, including forming the lines with a reduced thickness, forming the lines as a through cut with intermittently arranged bridging webs, forming the lines as a plurality of perforations, etc.

The lines need not be linear, but can be curved or inflected. The two lines need not be parallel. In a modified form of this embodiment of the invention, a single frangible line could be used to separate the annular wall.

For the cap 40 to be initially opened, the sleeve must be removed. The tab 76 is grasped and the tear-off strip is pulled outwardly and downwardly to tear the sleeve along the lines of weakness 62, 64. After the tear off strip 72 is removed the sleeve can be forcibly opened up or spread open to be removed from the container neck. The external, partially annular flange 53 provides rigidity to stabilize the sleeve during tear-removal of the tear-off strip 72.

Figure 2:
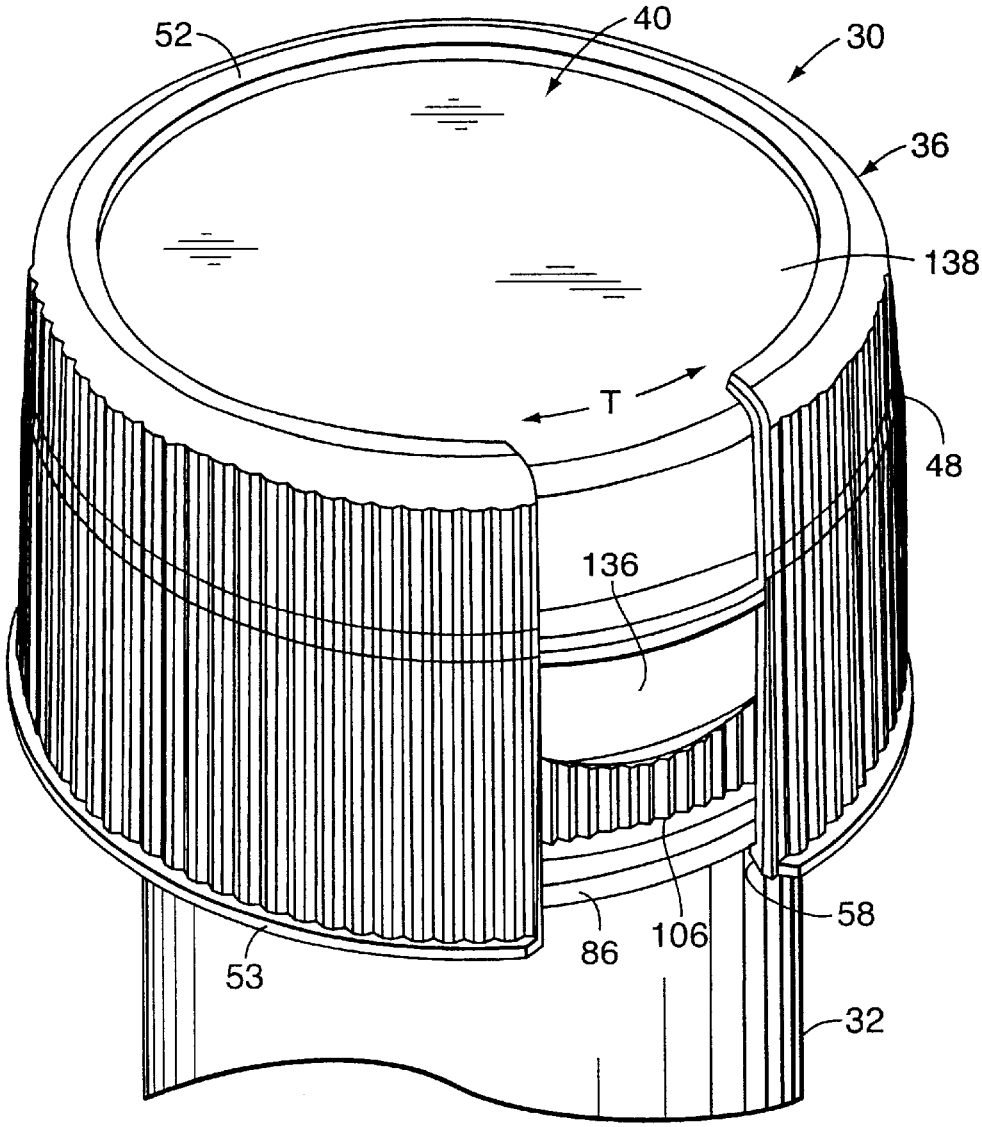
FIG. 2 is a perspective view of the closure structure of FIG. 1 with a tamper-indicating tear strip of the tamper-evident sleeve removed.

FIG. 2 illustrates the tamper-indicating sleeve 36 having been torn to be removed from the container neck 32. With the tear strip 72 missing, the annular sidewall 48 can be spread sufficiently in the tangential or radial direction to facilitate removal of the sleeve 36 axially, or radially, over a container neck retaining element 86 (described below), from the container neck 32.

Figure 3:
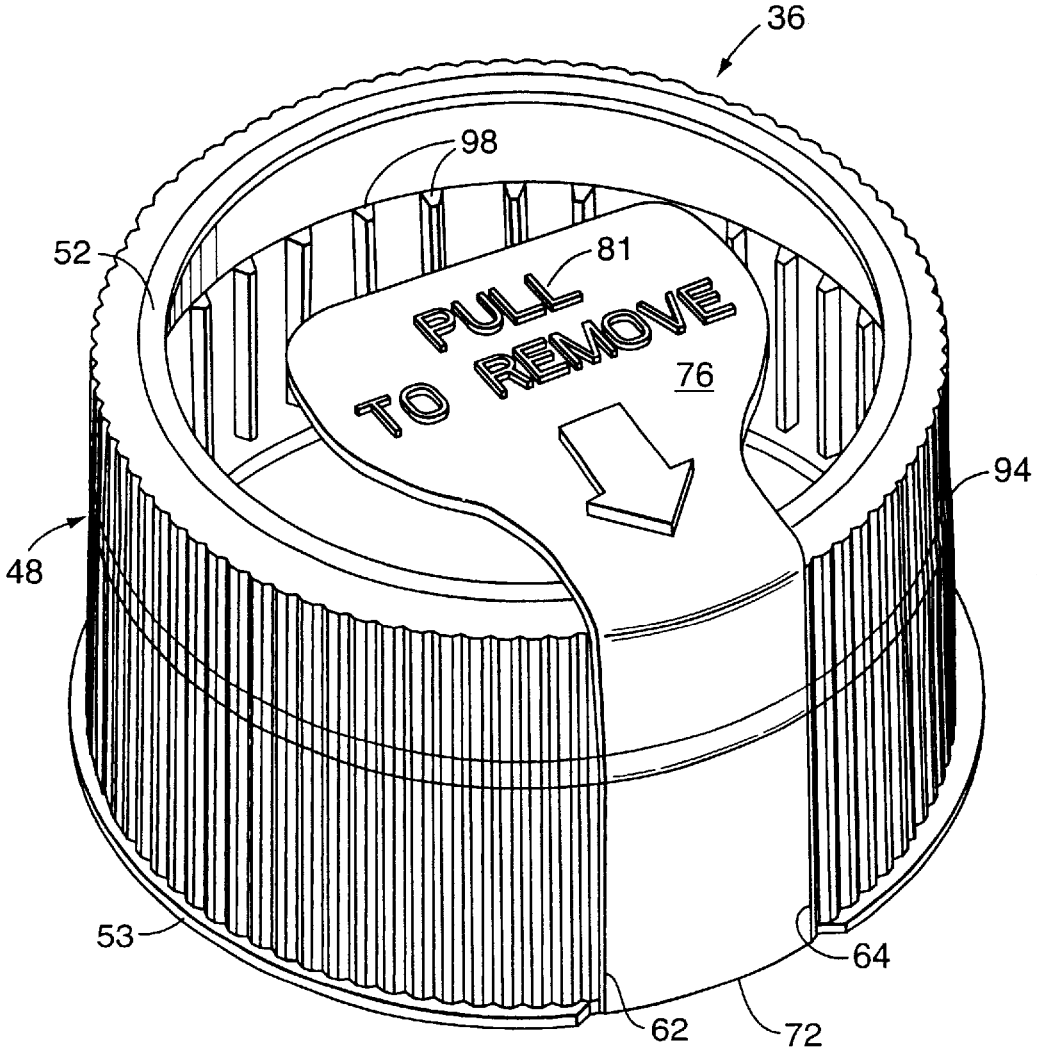
FIG. 3 is a perspective view of the tamper-evident sleeve of FIG. 1, separate from the closure assembly.

FIG. 3 illustrates the tamper-indicating sleeve 36 in isolation. The sleeve can include knurling or ribs 94 on an outside surface for gripping by capping machinery to screw on the closure structure to a container neck. The sleeve can also include internal knurling or ribs 98 on an inside surface thereof. The internal knurling or ribs 98 engage external knurling or ribs 106 on the cap 40 (shown in FIG. 2), so that the torque applied by the capping machine to the closure structure 30 is transferred through the sleeve 36 to the cap 40 for screwing the closure structure on the container neck 32.

Figure 4:
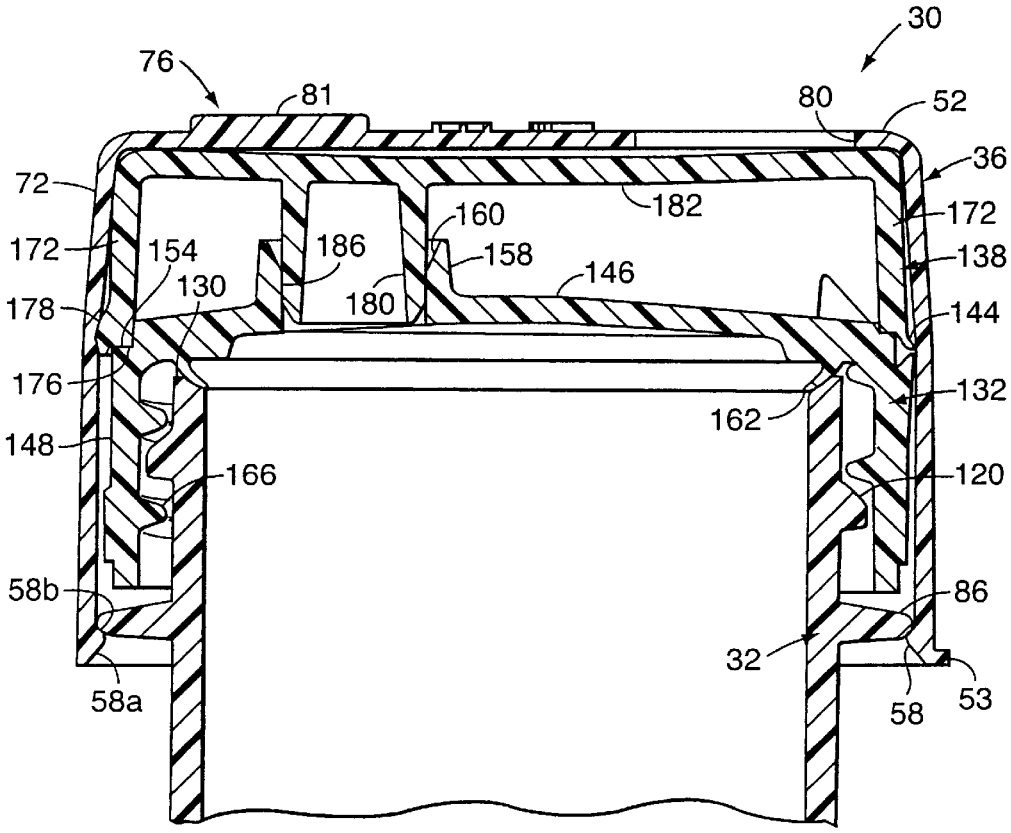
FIG. 4 is a sectional view taken generally through line 4—4 of FIG. 1.

As can be seen in FIG. 4, the closure structure 30 is engaged to the container neck 32. The container neck 32 includes an external thread formation 120 and the retaining element 86, in the form of a flange or a ring. The container neck 32 also includes a top container finish or annular sealing surface 130.

The cap 40 of the closure structure includes a closure body 132 and a lid 138 connected together by a hinge 144. The closure body 132 includes a deck 146 and a depending, hollow, generally cylindrical skirt 148. An annular shoulder 154 is defined on the top of the skirt 148, surrounding the deck 146. The closure structure also includes a spout 158 extending upwardly from the deck 146. A compressible seal 162 extends from the bottom surface of the deck. This seal can be a "crab's claw" seal or any other suitable seal.

The interior of the skirt 148 also defines an internal, female thread 166. The skirt 148 is adapted to receive and threadingly engage the upper end of the container neck 32. The skirt thread 166 is adapted to matingly engage the thread 120 of the container neck 32. Full engagement of the threads 120, 166 causes the top sealing surface 130 of the container neck to compress the cap body compressible seal 162 to form a seal between the closure structure 30 and the container neck 32. The top sealing surface 130 may be flat, angled, or curved and is sealingly engaged by the seal 162 as shown in FIG. 4.

As an alternative to threading, the closure skirt 148 could be provided with some other container connecting means, such as a snap-fit bead or groove (not illustrated) in place of the thread 166 for engaging a container groove or bead (not illustrated), respectively, in the container neck.

The tamper-evident sleeve of the exemplary embodiment of FIGS. 1–4 prevents unauthorized, undetected opening of the lid from the body and/or the unauthorized, undetected removal of the body from the container neck. In an alternate embodiment where tamper-evidency of only the lid alone is necessary, the closure body 132 could be permanently attached to the container by means of induction melting, ultrasonic melting, gluing, or the like, depending on materials used for the closure body 132 and container. The closure body 132 could also be formed as a unitary part, or extension, of the container.

The closure body skirt 148 may have any suitable configuration. The container could have an upwardly projecting "neck" or other portion for being received within the particular configuration of the closure body 132, and the main part of the container may have a same or a different cross-sectional shape than the container neck and closure body skirt 148. In this regard, "neck" only refers to that portion of the container that receives the closure structure, and is not limited to a portion which is more narrow than adjoining portions of the container, or the main body of the container. For example, the term "neck" also encompasses the closure-structure-receiving portion of a tubular container, wherein the neck has the same diameter as the remaining portions of the container.

The closure structure 30 is adapted to be used with a container having a mouth or other opening to provide access to the container interior and to a product contained therein. The product may be, for example, a comestible product such as a food paste, jelly or jam. However, the closure structure 30 could also be used with many other materials, including, but not limited to, relatively low or high viscosity liquids, particulates, etc. as constituting a food product, a personal care product, an industrial or household cleaning product, or other chemical compositions (e.g., compositions for use in activities involving manufacturing, commercial or household maintenance, construction, agriculture, etc.).

The container with which the closure structure may be used would typically be a squeezable container having a flexible wall or walls which can be grasped by the user and squeezed or compressed to increase the internal pressure within the container so as to force the product out of the container and through the closure structure 30. The container wall typically has sufficient, inherent resiliency so that when the squeezing forces are removed, the container wall returns to its normal, unstressed shape. Such a squeezable wall container is preferred in many applications but may not be necessary for preferred in other applications. For example, in some applications it may be desirable to employ a generally rigid container and pressurize the container interior at selected times with a piston or other pressurizing system.

The lid 138 is preferably hingedly connected to the closure body 132, with the hinge 144 preferably being a snap-action hinge. Such a hinge is disclosed in the U.S. Pat. No. 5,642,824, the disclosure of which is incorporated herein by reference thereto. In an alternate embodiment, the lid 138 need not be connected with a snap-action hinge. A floppy hinge may be used instead. Further, in another embodiment (not illustrated), the hinge 144 may be omitted entirely, and the lid 138 can be completely separate, and completely removable, from the closure body. In some applications, the lid 138 be omitted altogether.

The lid 138 includes a sidewall or lid skirt 172 (FIG. 4) from which the hinge 144 extends to the body 132. The lid skirt 172 has a lid seating surface 176. When the lid 138 is closed, the lid seating surface 176 engages the annular shoulder 154 defined on the closure body 132 at the top of the closure body sidewall 148. The lid 138 includes a lifting tab 178 extending radially outwardly on a front side of the lid 138. A lifting tab is not required, however. The lifting tab 178 is used to facilitate opening the lid after the sleeve is removed. The lifting tab 178 and the sleeve 36 are sized and shaped to resiliently interfere, as schematically indicated in FIG. 4 by the overlapping cross sections of the two parts in their relaxed state. The interference acts to retain the closure body 132 and lid 138 within the sleeve 36 prior to assembly on the container neck 32. The interference also acts to ensure that the closure body 132 rotates with the sleeve during installation of the closure structure 30 on the container neck 32. This is especially important if the interior knurling or ribs 98 (shown in FIG. 3) are not used.

The lid 138 includes an orifice sealing member or "spud" 180 which extends from a lid end wall 182 and which is adapted to sealingly engage a peripheral surface 186 of the orifice 160 when the lid 138 is pivoted from the open position to a closed position. As will be recognized, the orifice sealing member 180 is of a complementary shape relative to the shape of the dispensing orifice 160. The lid end wall 182 functions as an occluding portion which is movable to (1) a closed position to cover the dispensing orifice, and (2) an open position away from the closed position to uncover the dispensing orifice.

In the tamper-indicating ready position illustrated in FIGS. 1 and 4, the retention member 52 overlies the end wall 182 of the closure lid 138 and prevents the lifting thereof. The annular or partially annular bead 58 underlies the retaining element 86 of the container neck 32 to prevent removal of the sleeve 36 in an upward direction. In this regard, the bead 58 includes a gradually sloping leading side 58*a* and a steeply sloping retention side 58*b*. The gradually sloping leading side 58*a* allows the bead 58 to resiliently pass over the retaining element 86 during initial installation on the container neck. The steeply sloping retention side 58*b* prevents the unauthorized and undetected removal of the sleeve 36 from the container neck 32.

For the closure lid 138 to be initially opened, the sleeve 36 must be removed. The tab 76 is grasped and the tear-off strip 72 is pulled outwardly and downwardly to tear the sleeve along the lines of weakness 62, 64. After the tear off strip 72 is removed, the sleeve 36 can be opened up to be removed from the container neck 32. Thereafter, to dispense material from the container, the lid 138 is pivoted about the hinge 144 until the spud 180 is removed from the orifice 160.

The closure structure 30 is advantageously configured to be easily and cost effectively installed onto a container neck 32. The closure structure 30 as a unit is mounted onto the container neck 32 and turned to advance the closure threads 166 on the container threads 120. Additionally, as the threads 166 advance, the bead 58 passes over the retaining element 86 to be engaged as shown in FIG. 4. In this manner, the entire closure structure 30, including the tamper-evident sleeve 36 and cap 40, can be installed by the capping machine in a single step.

Figure 5:
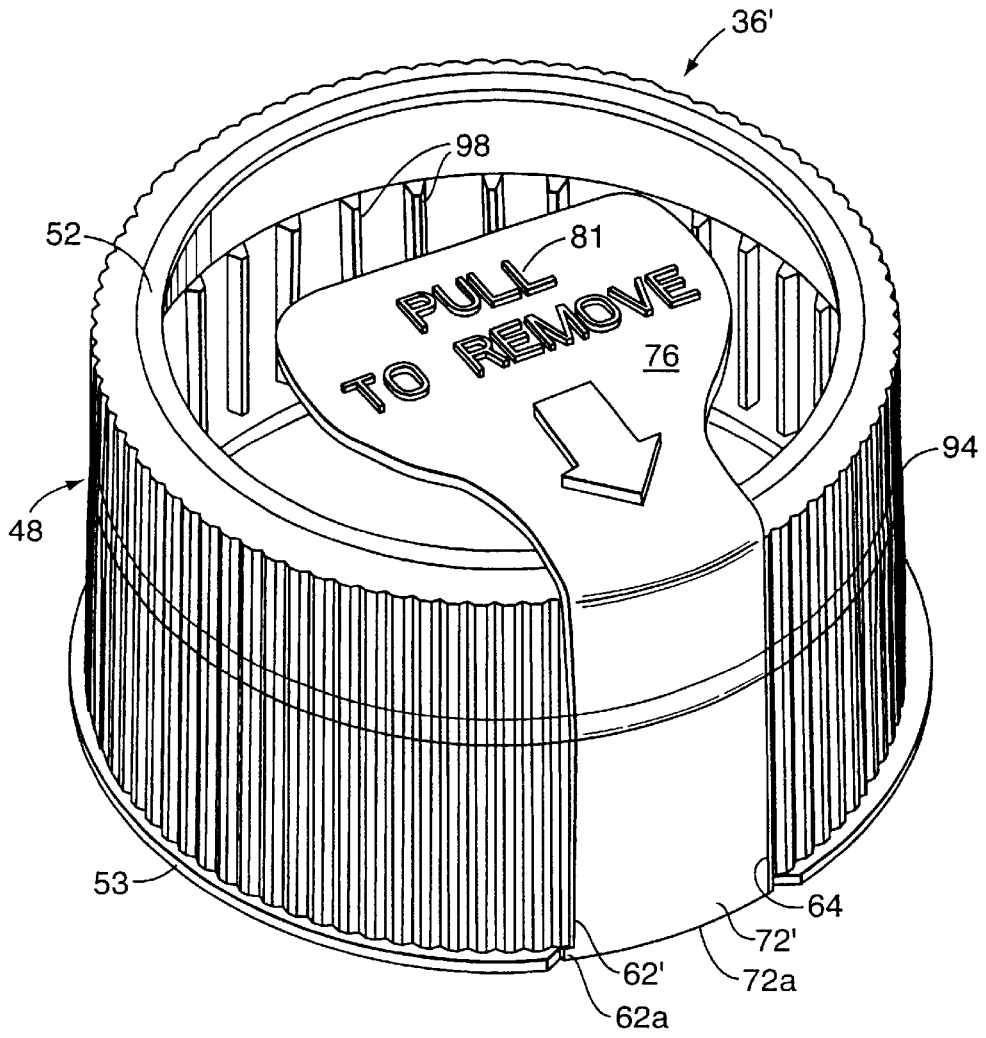
FIG. 5 is a perspective view of an alternate embodiment tamper-evident sleeve, separate from the closure assembly.

FIG. 5 illustrates an alternate embodiment tamper-evident sleeve 36' which includes a modified tear-off strip 72'. The modified tear-off strip 72' is defined between the prior described line of weakness 64 and a modified line of weakness 62'. The modified line of weakness 62' stops short of a bottom edge 72*a* of the strip to form an attachment web 62*a* between the edge 72*a* and the line of weakness 62'. Thus, by pulling the tab 76 down, the tear-off strip can be completely separated from the sleeve at the line 64 but only partially separated from the sleeve at the line 62'. The advantage of this arrangement is that rather than two scrap pieces being formed by the sleeve, only a single scrap piece, including the sleeve with attached strip 72' and tab 76, is formed.

FIGS. 6–9 illustrate another embodiment of a tamper-evident sleeve 36A which is adapted for being disposed around a cap 40 on a container neck, such as the cap 40 and container neck 32 described above with reference to the first embodiment of the sleeve illustrated in FIGS. 1–4.

Figure 6:
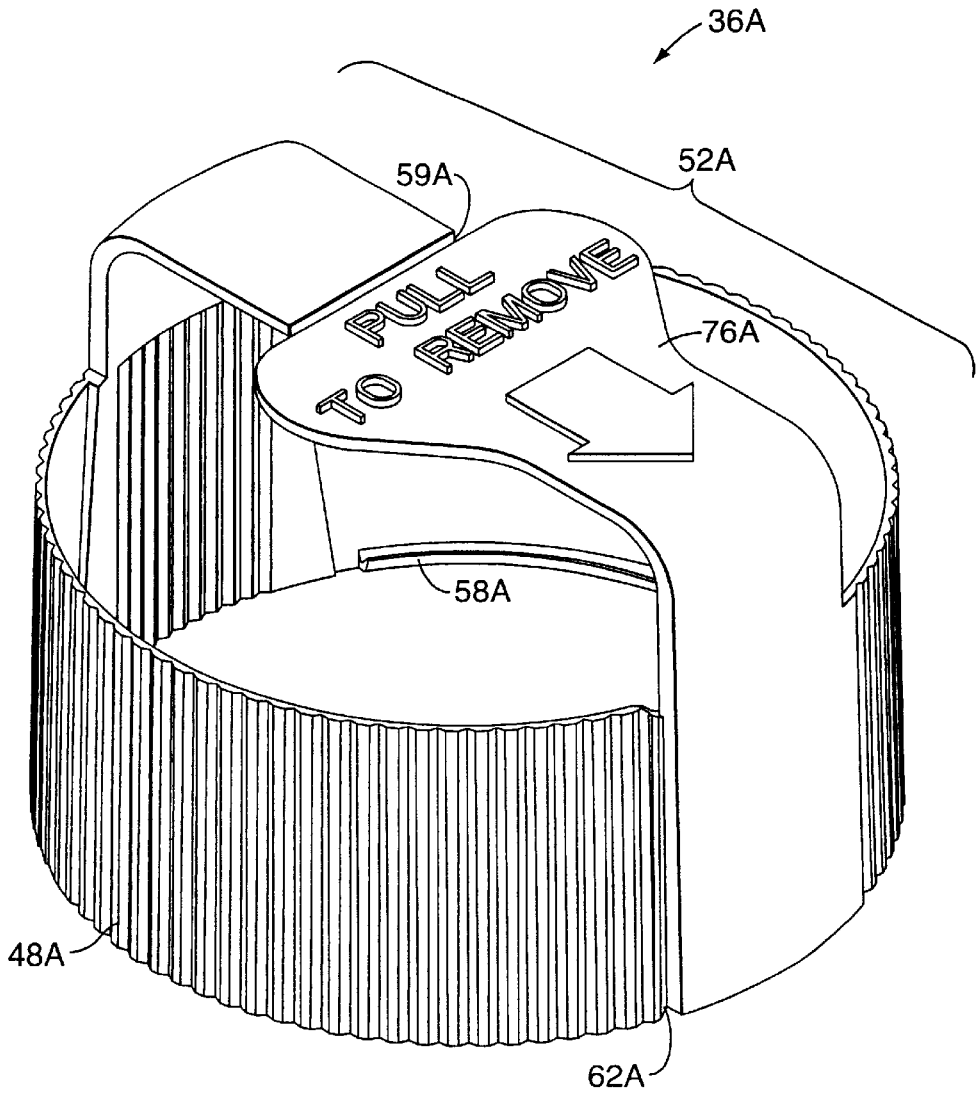
FIG. 6 is a perspective view of a further embodiment of a tamper-evident sleeve which is one of the components of a closure assembly.
Figure 8:
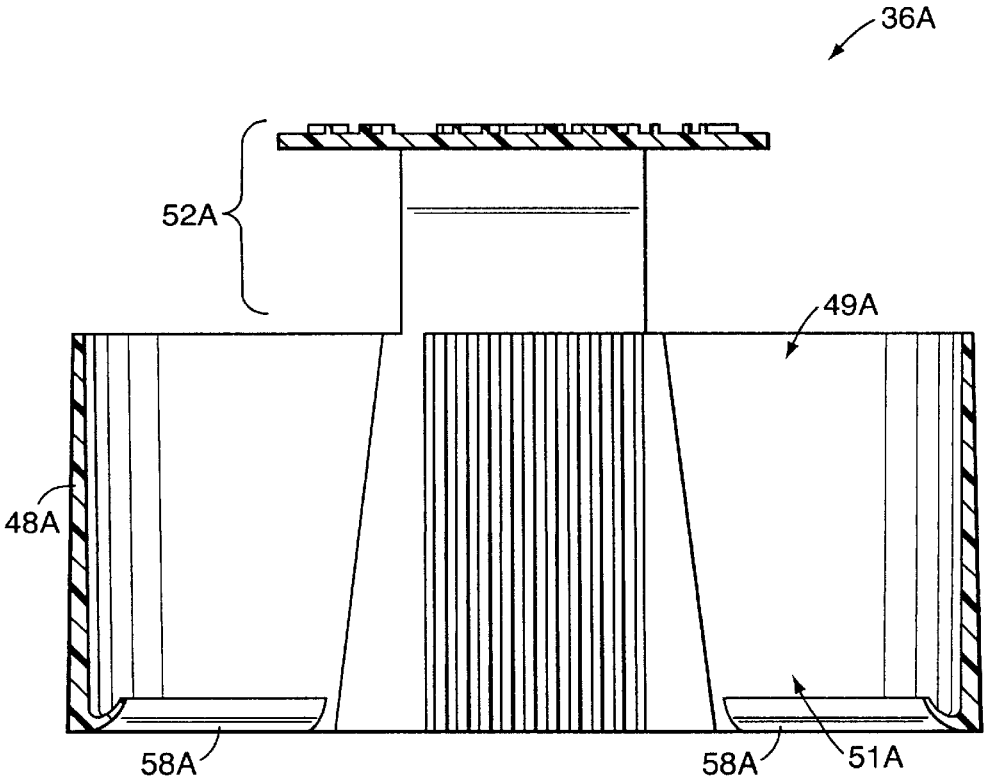
FIG. 8 is a cross-sectional view taken generally along the plane 8—8 in FIG. 7.
Figure 9:
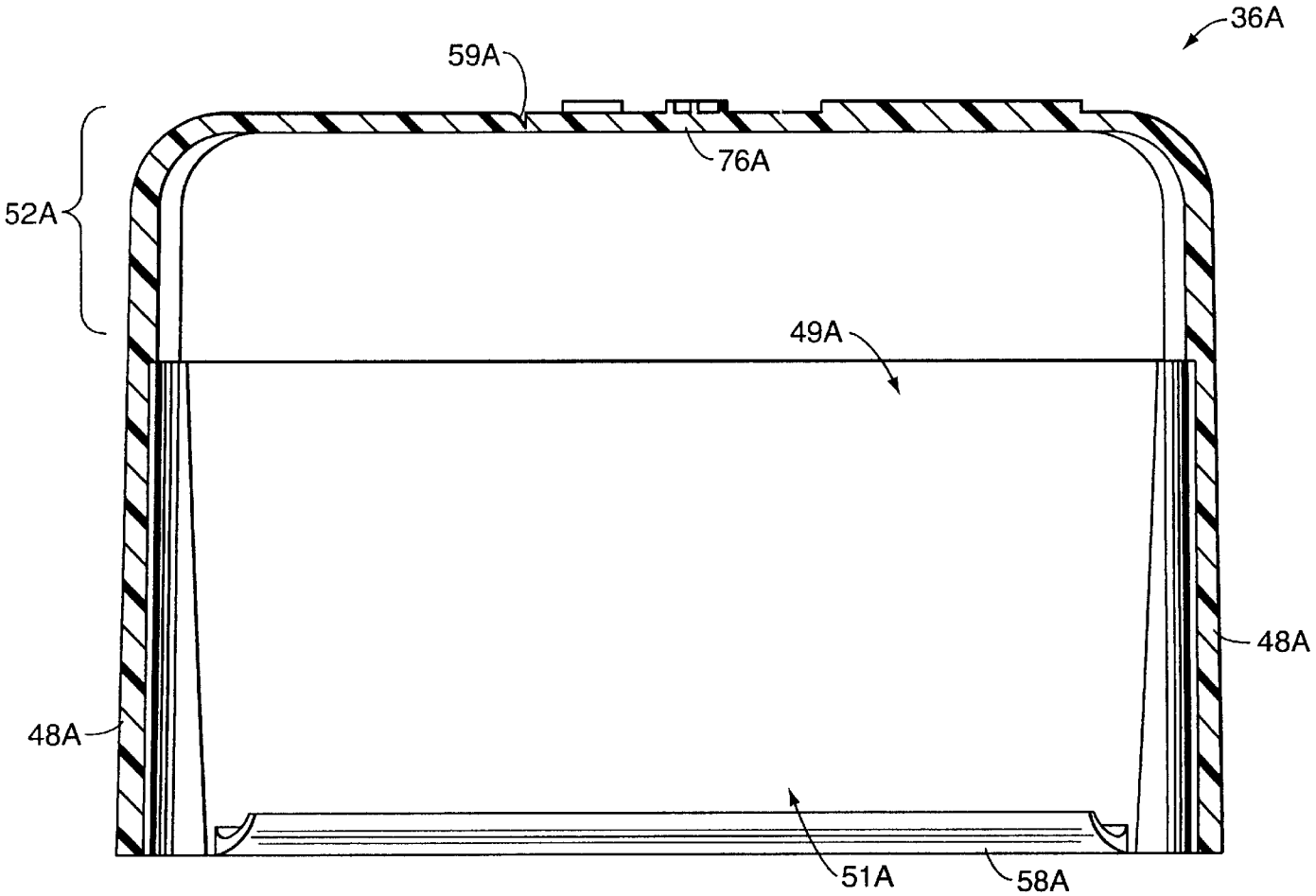
FIG. 9 is a greatly enlarged, cross-sectional view taken generally along the plane 9—9 in FIG. 7.

The sleeve 36A is molded as a unitary structure, preferably from a polymer material. As can be seen in FIG. 6, the sleeve 36A has an annular wall or sidewall 48A which is sized to surround the cap 40 on the container. The annular wall 48A has an upper opening 49A (FIG. 8) and a lower opening 51A (FIG. 8). As shown in FIGS. 8 and 9, the annular wall 48A has at least one engagement member 58A. In the preferred form of the embodiment shown in FIGS. 6–9, there are two engagement members 58A, each oriented along an arc on the inner circumference of the annular wall 48A at the bottom edge of the annular wall 48A. Each lip 58A, in the preferred embodiment illustrated in FIG. 7, extends for less than one half of the interior circumference of the annular wall 48A. Each engagement member 58A may be characterized as a bead or upturned lip 58A which, when the sleeve is installed over a cap on a container neck having a radially extending retaining element or flange 86 (FIG. 4), is adapted to temporarily and elastically deform sufficiently to bend past, and spring back below, the retaining element 86 on the container neck. This engagement prohibits axial separation of the surrounding sleeve 36A from the container neck.

As can be seen in FIG. 6, the sleeve 36A includes a retention member 52A extending across the sleeve upper opening 49A (FIG. 8) as a unitary part of the sleeve 36A to connect two portions of the annular wall 48A at a location over the upper opening 49A.

Further, as can be seen in FIG. 6, the sleeve 36A includes a top frangible line 59A across the retention member 52A at a location over the upper opening 49A (FIG. 9).

Figure 7:
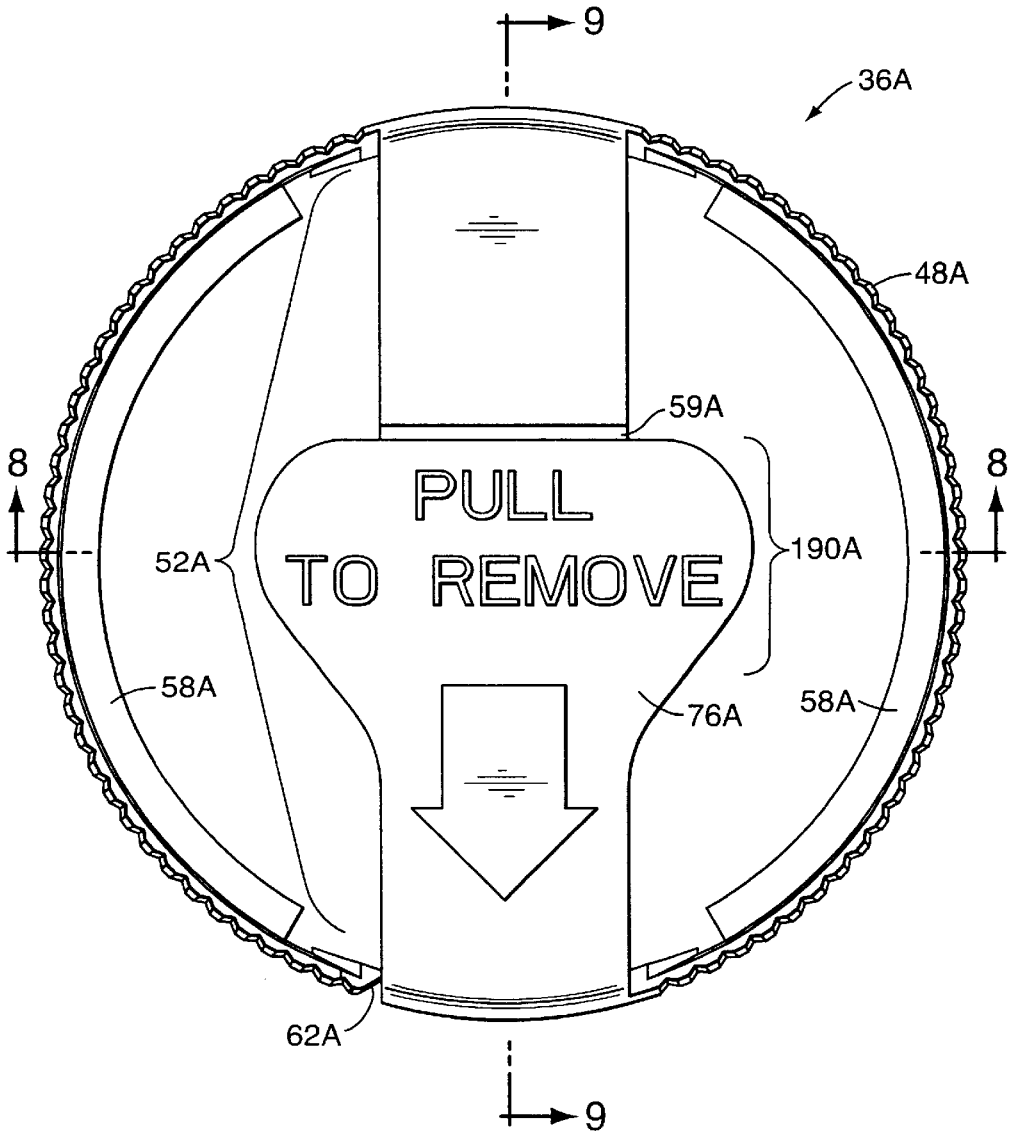
FIG. 7 is a top plan view of the sleeve shown in FIG. 6.

As can be seen in FIGS. 6 and 7, a side frangible line 62A extends throughout the height of the annular wall. As can be seen in FIG. 6, a pull tab 76A is defined as a unitary part of the retention member 52A between the top frangible line 59A and the sleeve annular wall 48A. The pull tab 76A can be pulled to tear the top frangible line 59A and the side frangible line 62A for, in effect, separating the sleeve 36A at two locations so that it can be spread apart or pried apart and removed from the cap and container. That is, by spreading the torn sleeve portions outwardly, the bottom engagement member lips 58A can be moved out from under the container neck retaining element flange 86 (FIG. 4). This allows the removal of the torn sleeve 36A from the cap and container.

Each frangible line 59A and 62A may be defined as a reduced thickness section of material. As can be seen in FIG. 9, the frangible line 59A is created by a groove, void, or notch extending downwardly from the upper surface of the retention member 52A. Similarly, as can be seen in FIG. 7, the side frangible line 62A is formed by a groove, notch, or void extending inwardly from the exterior surface of the annular wall 48A. Each frangible line may be characterized as being a generally reduced thickness portion of material that defines a groove, void, or notch.

As can be seen in FIG. 7, the pull tab 76A includes a grip portion 190A which is laterally wider than the top frangible line 59A.

The annular wall 48A has a generally cylindrical configuration. The exterior of the annular wall 48A may be provided with ribs or serrations to facilitate gripping of the sleeve 36A by automatic installation machinery.

In the preferred embodiment illustrated in FIGS. 6, 7, and 8, the top edge of the annular wall 48A terminates below the top of the cap on the container when the sleeve 48A is installed on the container over the cap. The retention member 52A projects upwardly alongside an upper portion of the cap and then extends over the cap.

In a preferred form of the sleeve illustrated in FIGS. 6–8, the annular wall 48A is adapted to surround and engage the closure body or cap with sufficient force to hold the sleeve and cap body together as a unit to accommodate installation of the sleeve and cap together on the container so that relative rotation between the cap and sleeve is minimized, at least during installation of the cap and sleeve on the container. Preferably, such installation is most readily effected by employing automatic cap/sleeve installation machinery.

It will be appreciated that modifications of other features of the invention are contemplated. For example, the closure body or unitary cap could be snap-fit onto the container neck with a cooperating annular bead and groove arrangement of conventional or special design.

Each embodiment of the sleeve 36, 36', or 36A may be initially assembled on a closure or cap and the assembly then may be installed on the container. However, in other forms of the invention, the closure or cap may be first installed on the container, and then the sleeve 36, 36', or 36A may be subsequently installed over the closure or cap on the container. In such a two-step installation, there would be no need to have frictional engagement between the sleeve and the cap.

The closure or cap need not incorporate a separate body and movable lid such as in the first embodiment illustrated in FIG. 4 wherein the closure has a body 132 and a lid 138 hingedly connected to the body 132 with a hinge 144. Rather, in an alternate embodiment (not illustrated), a single, unitary, removable cap could be employed for being releasably attached to a container—removal of such a cap from the container being possible only after removing the tamper-evident sleeve 36, 36', or 36A. Removal of the cap would expose the opening in the container neck. Such a cap need not be a dispensing type closure having a closure body and associated lid movable relative thereto. Rather, such a cap could be merely a unitary cover adapted to be releasably mounted, connected, or otherwise attached to the container neck.

The closure body could also be molded as a unitary part or extension of the container neck if such a container is molded initially with an open bottom end to allow mold core parts to be extended into, and then retracted from, the space within the container and container neck. Such a closure body portion of a container neck could be provided with a unitary molded end wall defining a small dispensing orifice over the larger, main opening defined by the container neck. A separate, or attached, lid could be mounted on the closure body portion for movement between a closed position occluding the dispensing orifice and an open position spaced from the dispensing orifice. After installing and closing the lid, the container could be inverted and filled through the open bottom end. Then the bottom end could be closed with a suitable secondary closure.

It is also possible to incorporate a friction fit of the cap and container facilitated by a cap or closure skirt having an inside diameter sized to provide a sliding or telescoping engagement with a smooth, threadless container finish. In such an embodiment, the container neck and closure body could be provided with abutment surfaces, for example, a bayonet type interlock or fastening configuration, which permit installation of the closure assembly on the container, but which may be configured to restrict upward movement of the closure body relative to the container.

It will be readily apparent from the foregoing detailed description of the invention and from the illustrations thereof that numerous variations and modifications may be effected without departing from the true spirit and scope of the novel concepts or principles of this invention.

What is claimed is:

1. An assembly of components for being retained together to define a closure structure for being subsequently installed on a container, having a neck that defines (a) a dispensing opening, (b) an external male thread formation formed on said container neck, and (c) a retaining element extending radially from said container neck and axially spaced from said container neck dispensing opening, the assembly comprising:

a closure body having an end wall defining a dispensing orifice in fluid communication with said dispensing opening, and an annular sidewall depending from said end wall and having an internal female thread formation engageable to the external thread formation on the container neck to mount said closure body on said container;

a closure lid on said closure body, said lid having an occluding portion that (a) is movable to cover said dispensing orifice in a closed position, and (b) is movable away from said closed position to uncover said dispensing orifice; and a tamper-evident sleeve that (a) surrounds and engages said closure body with sufficient force to hold said sleeve, closure body, and lid together as said assembly with said lid in said closed position for handling and to accommodate installation of said sleeve and closure body together with said lid as said assembly on said container neck so that relative rotation between said closure body and sleeve is minimized at least during installation of said closure body, lid, and sleeve together on said container neck, and (b) has a snap-on engagement member underlying said retaining element of said container neck after installation of said assembly on said container to (i) prevent axial upward displacement of said sleeve with respect to said container neck, and (ii) accommodate rotation of said sleeve, closure body, and lid together in the screwing on direction without fracturing said sleeve, (c) has a retention member overlying at least part of said closure lid to prevent movement of said occluding portion to uncover said dispensing orifice, and (d) has a frangible feature arranged to be torn to facilitate removal of said retention member from over said lid to permit said occluding portion to be moved to uncover said dispensing orifice.

2. The assembly in accordance with claim 1, wherein said frangible feature comprises a first frangible line arranged substantially in an axial orientation and extending throughout the height of said annular wall, and a second frangible line arranged substantially in an axial orientation and extending throughout at least a major portion of the height of said annular wall, said first and second frangible lines together defining between them a tear-off strip that can be torn away from said sleeve at least along one side at said first frangible line.

3. The assembly in accordance with claim 2, comprising a tab portion connected to said tear-off strip, said tab portion extending radially inwardly of said sleeve annular wall.

4. The assembly in accordance with claim 1, wherein said retaining element comprises a ring unitary with said container neck.

5. The assembly in accordance with claim 1, wherein said engagement member comprises at least a partially annular bead extending radially inwardly from said sleeve annular wall around a major portion of the inner circumference of said annular wall.

6. The assembly in accordance with claim 1, wherein said container has a body portion, and said neck extends from said body portion in the same or different cross sectional shape and with the same or different cross sectional dimension.

7. An assembly of components for being retained together to define a closure structure for being subsequently installed on a container having a neck that defines (a) a dispensing opening and (b) a radially extending retaining element spaced from said dispensing opening, the assembly comprising:

a cap having an end wall for at least partially closing said opening of said container neck and having a peripheral skirt for engaging said container neck to mount said cap on said container; and a surrounding sleeve having (a) an annular wall sized to surround and engage said cap skirt with sufficient force to hold said sleeve and cap together as said assembly and to accommodate installation of said sleeve and cap together as said assembly on said container neck so that relative rotation between said cap and sleeve is minimized at least during installation of said cap and sleeve together on said container neck, (b) a top retention member extending inwardly from said annular wall over at least a part of said cap, (c) a snap-on engagement member engageable with said container retaining element after installation of said assembly on said container to prevent axial separation of said surrounding sleeve from said container neck and to accommodate rotation of said sleeve and cap together in the screwing on direction without fracturing said sleeve, and (d) a frangible feature configured to be torn by a user for permitting at least partial disengagement of said engagement member from said retaining element and subsequent removal of said surrounding sleeve from said container neck.

8. The assembly in accordance with claim 7, wherein said frangible feature comprises a first frangible line arranged substantially in an axial orientation, and extending throughout the height of said annular wall, and a second frangible line arranged substantially in an axial orientation and extending throughout at least a major portion of the height of said annular wall, said first and second frangible lines together defining between them a tear-off strip that can be torn away from said sleeve at least along one side at said first frangible line.

9. The assembly in accordance with claim 8, said second frangible line extends only partway along the height of said annular wall and terminates short of the bottom edge of said sleeve so that said tear-off strip remains connected to a portion of said sleeve after said tear-off strip is torn completely along said first frangible line.

10. The assembly in accordance with claim 7, wherein said cap comprises a closure body that (1) is adapted to fit onto said container neck, and (2) defines said cap end wall and defines a dispensing orifice in said end wall so that said dispensing orifice is in fluid communication with said dispensing opening of said container neck; and a closure lid, said lid being movable relative to said closure body, and said closure lid having an occluding portion that moves with said lid between a closed position to occlude said dispensing orifice and an open position spaced from said dispensing orifice.

11. The assembly in accordance with claim 7, wherein said cap comprises a lid portion configured to be moved relative to the rest of the cap to selectively occlude said dispensing opening of said container neck.

12. The assembly in accordance with closure structure according to claim 7, wherein said container neck includes a first thread formation between said dispensing opening and said retaining element, and said cap includes a second thread formation engageable with said first thread formation to hold said cap on said container neck.

13. The assembly in accordance with claim 7, wherein said container has a body portion, and said neck extends from said body portion in the same or different cross sectional shape and with the same or different cross sectional dimension.

14. A An assembly of components retained together to define a closure structure for being subsequently installed on a container, that defines a dispensing opening, the assembly comprising:

a closure body having (1) an annular sidewall for extending from said container after installation of said assembly on said container, and (2) an end wall defining a dispensing orifice in fluid communication with said dispensing opening after installation of said assembly on said container;

a closure lid on said closure body for accommodating movement relative to said body and having an occluding portion movable with said lid to occlude said dispensing orifice in a closed position and movable with said lid away from said closed position to open said dispensing orifice;

a tamper-evident sleeve that (1) has an annular wall engaging at least one of said closure body and lid with sufficient force to hold said sleeve, body, and lid together as said assembly for handling and for accommodating installation of said sleeve, body, and lid together as said assembly on said container so that relative rotation between said sleeve, body, and lid is minimized at least during installation of said sleeve, body, and lid together on said container, and (2) is engageable with said container, after installation of said assembly on said container, to prevent axial upward displacement of said sleeve with respect to said container, said sleeve having a retention member overlying said closure lid to prevent movement of said lid to open said dispensing orifice, said sleeve including a frangible feature arranged to be torn to permit disengagement of said retention member from over said lid to allow said lid to be moved to open said dispensing orifice.

15. The assembly in accordance with claim 14, wherein said frangible feature comprises a first frangible line arranged substantially in an axial orientation, and extending throughout the height of said sleeve, and a second frangible line arranged substantially in an axial orientation and extending throughout at least a major portion of the height of said sleeve, said first and second frangible lines together defining between them a tear-off strip that can be torn away from said sleeve at least along one side at said first frangible line.

16. The assembly in accordance with claim 14, wherein said sleeve retention member is a partially annular lip.

17. The assembly in accordance with closure structure according to claim 15, wherein said frangible feature includes a tab portion extending radially inwardly from said tear-off strip.

18. The assembly in accordance with claim 14, wherein the container includes a retaining element extending radially outwardly therefrom, and said sleeve includes an engagement member extending radially inwardly therefrom to underlie said retaining element.

19. The assembly in accordance with claim 18, wherein said container includes a first thread formation between said dispensing opening and said retaining element, and said closure body includes a second thread formation engageable with said first thread formation to hold said closure body on said container.

20. The assembly in accordance with claim 18, wherein said retaining element comprises a radially outwardly directed ring and said engagement member comprises a radially inwardly directed bead.

21. The assembly in accordance with claim 14, wherein said container has a body portion and a neck which extends from said body portion in the same or different cross sectional shape and with the same or different cross sectional dimension.

* * * * *